US007464753B2

(12) United States Patent
White et al.

(10) Patent No.: US 7,464,753 B2
(45) Date of Patent: Dec. 16, 2008

(54) METHODS AND APPARATUS FOR ENHANCED PRODUCTION OF PLUNGER LIFT WELLS

(75) Inventors: Arthur F. White, Westminster, CO (US); John Coley, Thornton, CO (US)

(73) Assignee: Time Products, Inc., Broomfield, CO (US)

( * ) Notice: Subject to any disclaimer, the term of this patent is extended or adjusted under 35 U.S.C. 154(b) by 114 days.

(21) Appl. No.: 11/396,533

(22) Filed: Apr. 3, 2006

(65) Prior Publication Data

US 2007/0261845 A1 Nov. 15, 2007

(51) Int. Cl.
*E21B 43/12* (2006.01)

(52) U.S. Cl. ..... 166/250.15; 166/372; 166/370; 166/53

(58) Field of Classification Search ..... 166/53, 166/68, 250.15, 370, 372
See application file for complete search history.

(56) References Cited

U.S. PATENT DOCUMENTS

| | | | | |
|---|---|---|---|---|
| 4,150,721 | A | 4/1979 | Norwood | |
| 4,352,376 | A | 10/1982 | Norwood | |
| 4,354,524 | A | 10/1982 | Higgins | |
| 4,355,365 | A * | 10/1982 | McCracken et al. | 377/2 |
| 4,532,952 | A | 8/1985 | Norwood | |
| 4,633,954 | A | 1/1987 | Dixon | |
| 4,685,522 | A * | 8/1987 | Dixon et al. | 166/372 |
| 4,921,048 | A * | 5/1990 | Crow et al. | 166/372 |
| 4,989,671 | A * | 2/1991 | Lamp | 166/53 |
| 5,132,904 | A | 7/1992 | Lamp | |
| 5,146,991 | A | 9/1992 | Rogers, Jr. | |
| 5,785,123 | A * | 7/1998 | Lea, Jr. | 166/369 |
| 5,878,817 | A | 3/1999 | Stastka | |
| 5,957,200 | A * | 9/1999 | Majek et al. | 166/250.15 |
| 5,984,013 | A | 11/1999 | Giacomino | |
| 6,012,015 | A * | 1/2000 | Tubel | 702/6 |
| 6,241,014 | B1 * | 6/2001 | Majek et al. | 166/53 |
| 6,595,287 | B2 * | 7/2003 | Fisher | 166/250.15 |
| 6,719,060 | B1 * | 4/2004 | Wells | 166/372 |
| 7,243,730 | B2 * | 7/2007 | Casey | 166/372 |
| 2004/0104027 | A1 * | 6/2004 | Rossi et al. | 166/250.15 |
| 2007/0012442 | A1 * | 1/2007 | Hearn | 166/250.15 |

OTHER PUBLICATIONS

Gaweda et al. (2003); "Data-driven linguistic modeling using relational fuzzy rules"; *IEEE Transactions on Fuzzy systems* 11(1):121-134.

Joo et al. (1999) "Hybrid state-space fuzzy model-based controller with dual-rate sampling for digital control of chaotic systems"; *IEEE Transactions on Fuzzy Systems* 7(4):394-408.

Liu et al. (2005) "A probabilistic fuzzy logic system for modeling and control"; *IEEE Transactions on Fuzzy Systems* 13(6):848-859.

* cited by examiner

*Primary Examiner*—David J. Bagnell
*Assistant Examiner*—David Andrews
(74) *Attorney, Agent, or Firm*—Greenlee Winner and Sullivan, P.C.

(57) ABSTRACT

A microcontroller system for oil and gas wells using a plunger lift device, which responds to the variations in well production and operation. The system requires minimal operator input, and is able to calculate the operational cycles and adjustments to maximize well production and maintain environmental safety using non-linear artificial intelligence processes.

24 Claims, 6 Drawing Sheets

METHODS AND APPARATUS FOR ENHANCED PRODUCTION OF PLUNGER LIFT WELLS

CROSS-REFERENCE TO RELATED APPLICATIONS

Not Applicable.

STATEMENT REGARDING FEDERALLY SPONSORED RESEARCH

Not Applicable.

BACKGROUND OF THE INVENTION a. Field of the Invention

This invention relates to the control of hydrocarbon production using plunger lift systems. More specifically, it relates to controllers using measurements of conditions in subsurface wells to operate non-linear artificial intelligence processes to sequence the operation of plunger lift devices.

b. Discussion of the Prior Art

The control of oil and gas production wells are an on-going concern of the petroleum industry due, in part, to the monetary expense involved as well as the risks associated with environmental and safety issues.

In many hydrocarbon wells, that is gas and oil wells, as described in greater detail below, fluids accumulate within the well casing and production string which block the flow of the formation gas or oil into the borehole, and such accumulations reduce the production of hydrocarbons from the well. As used herein, "fluids" primarily refers to a combination of naturally occurring liquids and emulsions, including water, oil, paraffin or combinations thereof. As fluids accumulate within the well casing and production string, often referred to as "tubing string" or "tubing", the production of hydrocarbons from the well may diminish, and may ultimately fail due to the effect of pressure buildup of such fluids on the formation. Currently, the state-of-the art technique for removing accumulated fluids from the well casing and production string is through the use of plunger lift systems.

State-of-the art plunger lift production systems include a cylindrical plunger. In such a system, the cylindrical plunger normally resides at the bottom of the borehole, and is sized to travel through the production string extending from a location adjacent to the producing formation down in the bottom of the borehole upward to the surface equipment located at the hydrocarbon receiving end of the borehole. In general, fluids in the borehole that inhibit the flow of hydrocarbons out of the formation tend to collect in the lower portion of the production string. Periodically, a valve, typically a motor valve, in the production string at the surface of the well is opened at the surface. This allows accumulated reservoir pressure within the well to drive the plunger up the production string. The small clearance between the plunger and the well production string is such that the plunger carries with it to the surface a load of accumulated blocking fluids. The accumulated fluids are then ejected out of the top of the well, thereby allowing hydrocarbons to flow more freely from the formation into the well bore and be delivered to a distribution system at the surface. After the flow of gas has once again been restricted due to the further accumulation of fluids downhole, the surface valve of the well is closed, and the plunger, due to its own weight, then falls back down the production string to the bottom of the borehole. While the valve is so closed, the pressure within the well generally increases again. If the pressure is allowed to build to a strong enough level, the pressure will be strong enough to lift the plunger and another load of fluids to the surface of the well when the valve is reopened.

In plunger lift production systems, there is a requirement for the periodic operation of a motor valve at the surface of the wellhead to control the flow of fluids from the well to assist in the production of hydrocarbons and removal of fluids from the well. These motor valves are conventionally controlled by timing mechanisms and are currently programmed in accordance with principles of reservoir engineering, which determine the length of time that a plunger lift control valve should be either "closed" and restricted from the flowing of gas or liquids to the surface, and the time the plunger lift control valve should be "opened" to more freely produce.

If the plunger lift control valve is left opened or closed for too long of a time, there will be a loss of well production and the producing formation may be damaged. Furthermore, pressure buildup within a well can cause the plunger to rise to the surface at excessive speeds, which can cause serious damage to the surface components of the well and cause hydrocarbons and fluids from the well to leak into the surrounding environment. Not only does this present a safety risk to workers at the surface of the well, but it also presents serious environmental concerns. It is therefore seen that control of the plunger lift control valve is critical to maintain proper pressure and production balance within the well by avoiding having it be open or closed for too long or too short of a time.

It is extremely impractical to manually open and close the plunger lift control valve for each well. As a consequence, automatic controllers are currently used to open and close the motor valve. Generally, the criterion used in most systems for operation of the plunger lift control valve is strictly one of the elapse of pre-selected time periods. In most systems, measured well parameters, such as pressure and temperature, can be used to override the timing cycle in special conditions.

For example, in the patent prior art, U.S. Pat. No. 4,150,721 (Norwood) discloses a battery operated gas well controller system which utilizes digital logic circuitry to operate a well in response to a timing counter and certain measured well parameters. U.S. Pat. Nos. 4,352,376 and 4,532,952 (Norwood) disclose similar controllers comprising the use of a microprocessor. U.S. Pat. No. 4,354,524 (Higgins) discloses a pneumatic timing system which uses injected gas to artificially lift liquids to a well surface. U.S. Pat. No. 4,355,365 (McCracken) discloses a system for electronically operating a well in accordance with timing techniques wherein the well is allowed to flow for a pre-selected period of time and then closed for a second pre-selected period of time to effect the production from the well. U.S. Pat. No. 4,921,048 (Crow) discloses an electronic controller which detects the arrival of a plunger and monitors the time required for the plunger to make each trip to the surface. U.S. Pat. No. 5,146,991 (Rogers, Jr.) discloses a plunger lift well which evaluates plunger lift speed. U.S. Pat. No. 5,878,817 (Stastka) discloses a controller which opens the plunger lift control valve based on the measurement of the pressure difference between the gas in the tubing line and the pressure of gas in the sales line, and in addition uses the speed of the plunger to adjust valve operation. Similarly, U.S. Pat. No. 6,595,287 (Fisher) controls valve operation based on the pressure difference between sales line pressure and well casing pressure. U.S. Pat. No. 5,984,013 (Giacomino) uses plunger arrival time to adjust the subsequent valve opening and closing times.

It is currently observed that relatively simple, timed intermittent operation of plunger lift control valves is often not adequate to control outflow so as to optimize hydrocarbon production from wells. As a consequence, sophisticated computerized controllers positioned at the surface of production wells have been used for control of devices, such as the plunger lift control valves. Additional systems have been developed that relate to: (1) surface controller systems using a surface microprocessor; and (2) downhole controller systems which are initiated by surface control signals.

Surface controller systems generally teach computerized systems for monitoring and controlling a gas/oil production well whereby the control electronics is located at the surface and communicates with sensors and electromechanical devices near the surface. An example of this system is disclosed in U.S. Pat. Nos. 4,633,954 (Dixon) and 4,685,522 (Dixon), which describe a fully programmable microprocessor controller which monitors downhole parameters, such as pressure and flow, and controls the operation of gas injection to the well, outflow of fluids from the well, or shutting in of the well to maximize output. Another example of a controller system of this type is disclosed in U.S. Pat. No. 5,132,904 (Lamp), which further describes a feature where the controller includes serial and parallel communication ports through which all communications to and from the controller pass. Hand held devices or portable computers capable of serial communication may access the controller. A telephone modem or telemetry link to central host computer may also be used to permit several controllers to be accessed remotely. It is well recognized that petroleum production wells using surface based controllers will have increased production efficiencies and lower operating costs than downhole microprocessor controllers.

In general, although controller systems have become much more complex, they still do not fully optimize well production and often require a great deal of operator inputs. What is needed is a plunger lift system that optimizes the open and close cycles of the motor valve based on minimal input. Additionally, well operation and production varies between different wells and can even change from cycle to cycle within the same well. For example, the gas pressure within a well will vary from well to well and can significantly change during the life of that well. Because each well will have its own unique properties, the automatic controller closing and opening the plunger lift control valve must be suitable for use on a wide variety of wells and be flexible enough to adjust to the changes that often occur during the life of the well to provide ongoing optimum production. Ideally, the operation of a plunger lift control valve by an automatic controller system would be able to approximate the operation of a controller system by an ever present and vigilant human operator.

SUMMARY OF THE INVENTION

The present invention teaches an automatic controller system and methods for controlling plunger assisted gas and/or oil wells. As detailed below, limited operator entry is required as the controller system calculates values used to control the plunger lift control valve of the well and optimize production. The controller system contains a microprocessor and memory, wherein the microprocessor utilizes a non-linear artificial intelligence process that controls when the well is closed and open, and determines the optimal operational plunger lift control valve cycles. As used herein, the term microprocessor is meant to include general-purpose microprocessors, microcontrollers, Digital Signal Processors (DSP), electronic data processing computers of all kinds, and combinations thereof. In one embodiment, the present invention provides a microprocessor that requires minimal operator input and utilizes Zadehan logic to optimize well operation after the required inputs are entered. Zadehan logic is also referred to as "fuzzy logic".

Zadehan logic and fuzzy logic sets are viewed as a mathematical formalism for the representation of uncertainty. Contrary to their name, the laws of fuzziness are not vague, but rather describe complex real systems operation with linguistic variables that may have varying membership functions and slope. Typically, spreadsheets are used to define the variables and degree of membership of external events. Graphs define the slope of the terms used for inputs and output data. The final system is compiled for compact representation of the complex system to be embedded in microprocessor firmware. Such use of Zadehan logic, or fuzzy logic, is well known in the art and is widely used in programmable controllers of all types, for example, see: (International Electrotechnical Commission (2000) International Standard, Programmable controllers-Part 7: Fuzzy control programming; Liu et al. (2005), "A probabilistic fuzzy logic system for modeling and control," IEEE Transactions on Fuzzy Systems 13(6):848-859; Gaweda et al. (2003), "Data-driven linguistic modeling using relational fuzzy rules," IEEE Transactions on Fuzzy Systems 11(1):121-134; Joo et al. (1999), "Hybrid state-space fuzzy model-based controller with dual-rate sampling for digital control of chaotic systems," IEEE Transactions on Fuzzy Systems 7(4):394-408).

As described in greater detail below, a gas or oil well utilizing an embodiment of the present invention comprises tubing, often in the form of a production string, positioned within a well casing; a plunger positioned within the production string, wherein the plunger is moveable within the production string; a plunger arrival sensor at the lubricator; a plunger lift control valve connected to the production string and the sales line; and, in some cases optional pressure sensors located at the annulus of the well casing, and a hydrocarbon take-off line, commonly referred to as a "sales line". The plunger lift control valve is operated to change the valve between a closed and an open position in response to a microprocessor in the operation of the present invention, as further detailed below.

Such a well using a plunger lift system operates using a series of cycles. As used herein, the term "operating cycle" refers to a repeating process of closing the plunger lift control motor valve to build sufficient pressure to lift the plunger to the surface followed by opening the plunger lift control valve to collect the oil and/or gas hydrocarbons from the well. Typically, each operating cycle comprises at least a close cycle, an open cycle, an afterflow cycle, and a fall cycle, as detailed immediately below.

The "close cycle" refers to the cycle during normal well operation wherein the plunger is at the bottom of the production string and the plunger lift control valve is closed, thereby preventing fluids and hydrocarbons within the production string from flowing to the surface of the well. When in a close cycle, the pressure within the well will generally increase. Preferably, the duration of the close cycle, also referred to herein as the "close time", is as short as possible, but still allows for enough pressure to build so as to push the plunger to the surface during an open cycle. That is, when the plunger lift control valve is opened, the time period referred to herein as the "open cycle", the plunger and the fluids that have accumulated in the production string above the plunger will rise to the surface of the well. The duration of the open cycle, also referred to herein as the "open time", should be long enough to ensure the plunger rises to the surface and is detected by the controller system. Once the fluids reach the surface of the well, they can be collected into a separator and hydrocarbons can more freely flow through the production string to the sales line. The period of time during which a well is producing the desired gaseous hydrocarbons is referred to as the "afterflow cycle". Preferably, the duration of each afterflow cycle, also referred to herein as the "afterflow time", is as long as possible for optimized well production. In typical operation, the well will proceed through a close cycle, followed by an open cycle, then an afterflow cycle, and then a "fall cycle" during which the plunger falls to the bottom of the production string. After the fall cycle, the well repeats the process starting with another close cycle.

In the practice of the process of the present invention, well parameters entered by an operator, measurements of the current well conditions, previous well measurements, and trends are assigned a value and applied to the Zadehan logic engine, which is stored on the microprocessor, to calculate the value of modifications required for improved cycle time and hydrocarbon production time.

In one embodiment of the invention, the minimal operator inputs required by the microprocessor controller system comprise the well depth, an initial close time required to recharge the well after a plunger arrives to the surface, and an initial afterflow time to allow collection of hydrocarbons after the plunger arrives to the surface of the well. From the required operator inputs, the Zadehan logic engine of the microprocessor will calculate the time required for the plunger lift control valve to be opened, fall time required for the plunger to fall to the bottom of the well, and backup time required to build up the pressure in the well should a plunger fail to reach the surface of the well. The various cycle times are then adjusted by the Zadehan logic of the microprocessor, preferably to reduce the time the plunger lift control valve is closed and increase the afterflow time when the desired hydrocarbons are collected. Non-linear pressure limits can be calculated and used after adjustment of the cycles to form an optimized closed loop system. In one embodiment, the microprocessor uses a high pressure limit and low pressure limit as additional parameters.

In one embodiment, the invention provides a method for optimizing the operation of a well having a plunger lift control valve connected between the production string of the well and the sales line, wherein a controller system is able to open and close the motor valve according to values stored on the controller system memory. The method comprises entering a predetermined value for well depth, close time, and afterflow time into the controller system memory, and conducting one or more operating cycles wherein the controller opens and closes the motor valve to allow fluids or gasses to flow through the sales line. The controller system automatically calculates the open time based on the entered predetermined values. Each operating cycle comprises entering a closed cycle for a period of time equal to the initial close time; opening the plunger lift control valve and entering an open cycle for a period of time equal to the calculated open time allowing fluids to be artificially lifted which allows the fluids to flow into the sales line; and entering an afterflow cycle for a period of time equal to the afterflow time and allowing gases to flow into the sales lines during the afterflow cycle. After one or more successful operating cycles, the Zadehan logic of the microprocessor controller system adjusts the close time and afterflow time based on current well conditions and previous well measurements. Subsequent adjusted operating cycles are conducted using the adjusted close time and afterflow time.

In a further embodiment, the close time is adjusted by the Zadehan logic engine after a number of operating cycles have been run using the initial close time and initial afterflow time. After there have been a number of successful operational cycles using the adjusted close time, the afterflow time is adjusted. After a number of successful operating cycles have been run using the adjusted afterflow time and close time, the controller system adjusts the afterflow time again using the Zadehan logic engine. This second adjustment is also referred to as the fine adjust.

The pressures in the sales line, well casing and production string can also be used by the Zadehan logic engine to open and close the plunger lift control valve. For example, the controller system can terminate a close cycle and enter an open cycle when the pressure in the well casing (also called the well annulus) exceeds the pressure in the sales line by a predetermined amount. The Zadehan controller system can also terminate an afterflow cycle when the current pressure in the well annulus is less than the minimum recorded well annulus pressure by a predetermined amount. The Zadehan controller system can also terminate an afterflow cycle when the current pressure in the sales line is less than the minimum recorded pressure at the well annulus by a predetermined amount.

The objects of the present invention will become apparent to those skilled in the art from the following detailed description and accompanying drawings, showing the contemplated novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings, which are incorporated in and form a part of this specification, illustrate complete preferred embodiments of the present invention according to the best modes presently devised for the practical application of the principles thereof, and in which.

DETAILED DESCRIPTION

Figure 1:
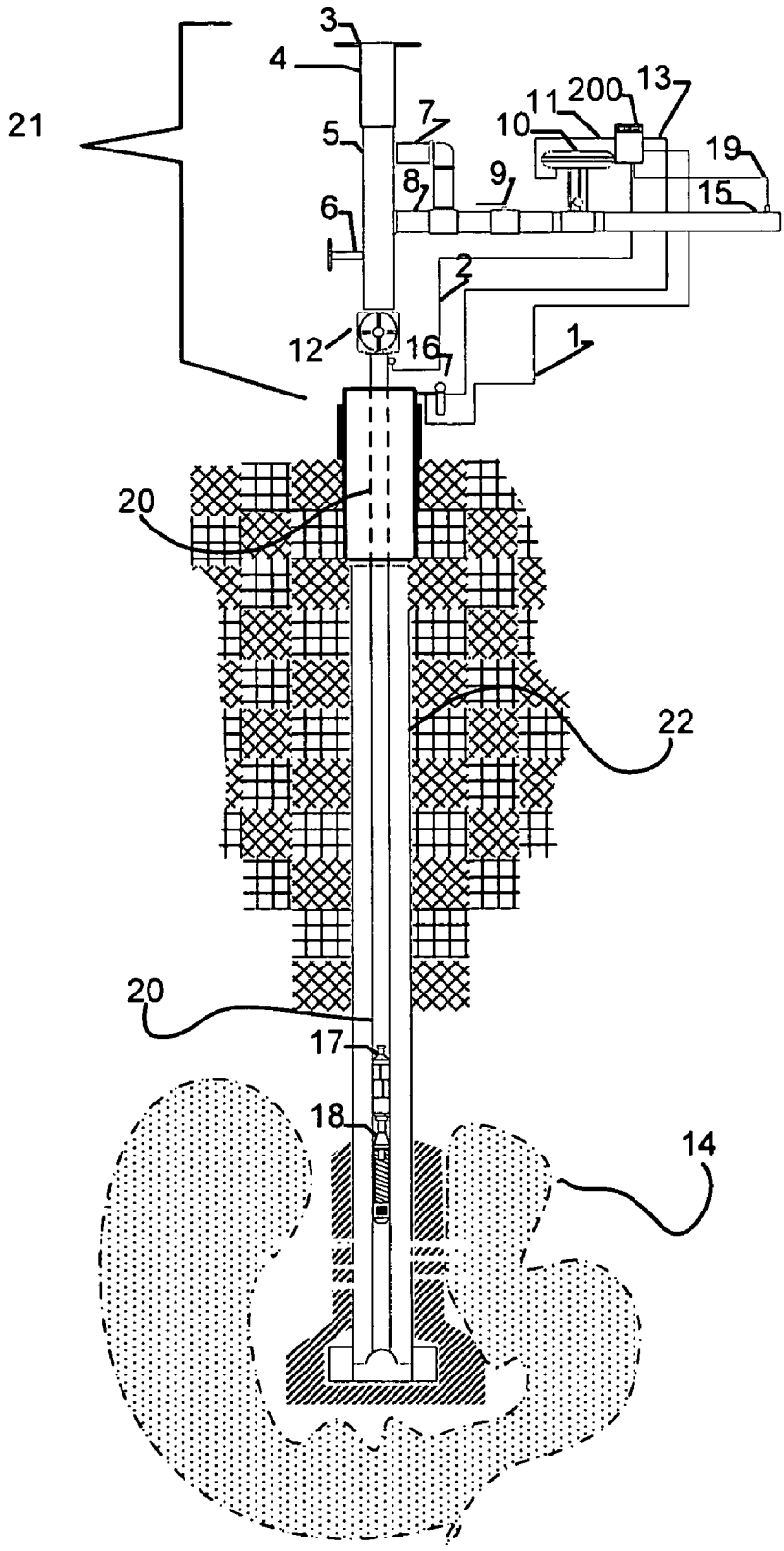
FIG. 1 shows a diagrammatic side view, partially in cross-section, of a well utilizing a plunger lift system that is connected to and operated by a Zadehan controller system of the present invention.

FIG. 1 shows one embodiment of the present invention with a well that has a plunger lift system. As shown, well casing 22 extends from the earth surface down into an oil-gas formation 14. The production string 20 is a series of connected elongated hollow tubes within well casing 22 that extends from wellhead 21 at the surface down to the bottom or near the bottom of well casing 22. Production string 20 is open at its lower end allowing fluids and hydrocarbons in the well casing 22 to enter the production string 20. Plunger 17 is disposed within production string 20, and is designed to move from the bottom of production string 20 to lubricator 5 which is located at the top of production string 20. At or near the bottom of production string 20 is a lower bumper spring 18, which catches and stops plunger 17 as it travels to the bottom of production string 20. An upper bumper spring 4 above the lubricator 5 stops plunger 17 as it is pushed through production string 20 to the surface by the pressure of the flow of hydrocarbons from oil-gas formation 14.

The top of production string 20 is connected to a master valve 12. When maintenance and repair of the system is required, master valve 12 is used to shut off the flow of hydrocarbons and thereby the pressure for maintenance and repair of the system. Above master valve 12 are a plunger catcher 6 and a lubricator 5. The plunger catcher 6 can be engaged by an operator to catch plunger 17 after it is caused to rise within production string 20 to lubricator 5. An upper bumper spring 4 is attached to the lubricator 5 by threads and can be unscrewed using handles 3. When the upper bumper spring 4 is removed, the plunger 17 can be removed and repaired, replaced, or inspected for damage.

Upper flow outlet 7 and lower flow outlet 8 connect a sales line 15 to the lubricator 5, such that sales line 15 is in fluid communication with production string 20. By "fluid communication", it is meant that fluids and hydrocarbons can flow from the production string 20 into the sales line 15 through upper flow outlet 7 and lower flow outlet 8. As is well known in the art, the other end of sales line 15 is attached to one or more separators (not shown) used to separate the fluids from the hydrocarbons. Shut-in valve 9 may be used to shut down flow through sales line 15 for maintenance.

The flow of fluids and hydrocarbons through sales line 15 is regulated by plunger lift control valve 10, which is connected to controller system 200, as further detailed and explained below, through motor valve connecting tubing 11. At the heart of the present invention, controller system 200 contains a microprocessor which calculates when plunger lift control valve 10 should be opened and closed. The controller system 200 uses an art known actuator (not shown), such as a solenoid valve or a pilot latch valve, to open and close the plunger lift control valve 10. When the controller system 200 activates plunger lift control valve 10 to an open position, and if there is sufficient pressure in production string 20, plunger 17 will be pushed from the lower bumper spring 18 at the oil-gas formation 14 and be pushed to the surface lifting accumulated fluids into sales line 15. A plunger arrival sensor 2 detects when plunger 17 arrives at lubricator 5 and relays this information to controller system 200. Plunger arrival sensor 2 can be electronic or mechanical. Additional monitoring devices, such as annulus pressure sensor 1 and sales line pressure sensor 19, relay pressure information to controller system 200. Gas from the well casing 22 is used by the controller 200 to mechanically control the open/close state of the motor valve 10. Gas from the well casing 22 is delivered to the controller system 200 through controller gas supply line 13. A regulator 16 attached to controller gas supply line 13 reduces the gas pressure to manageable levels, typically to approximately 25 PSI.

Figure 2:
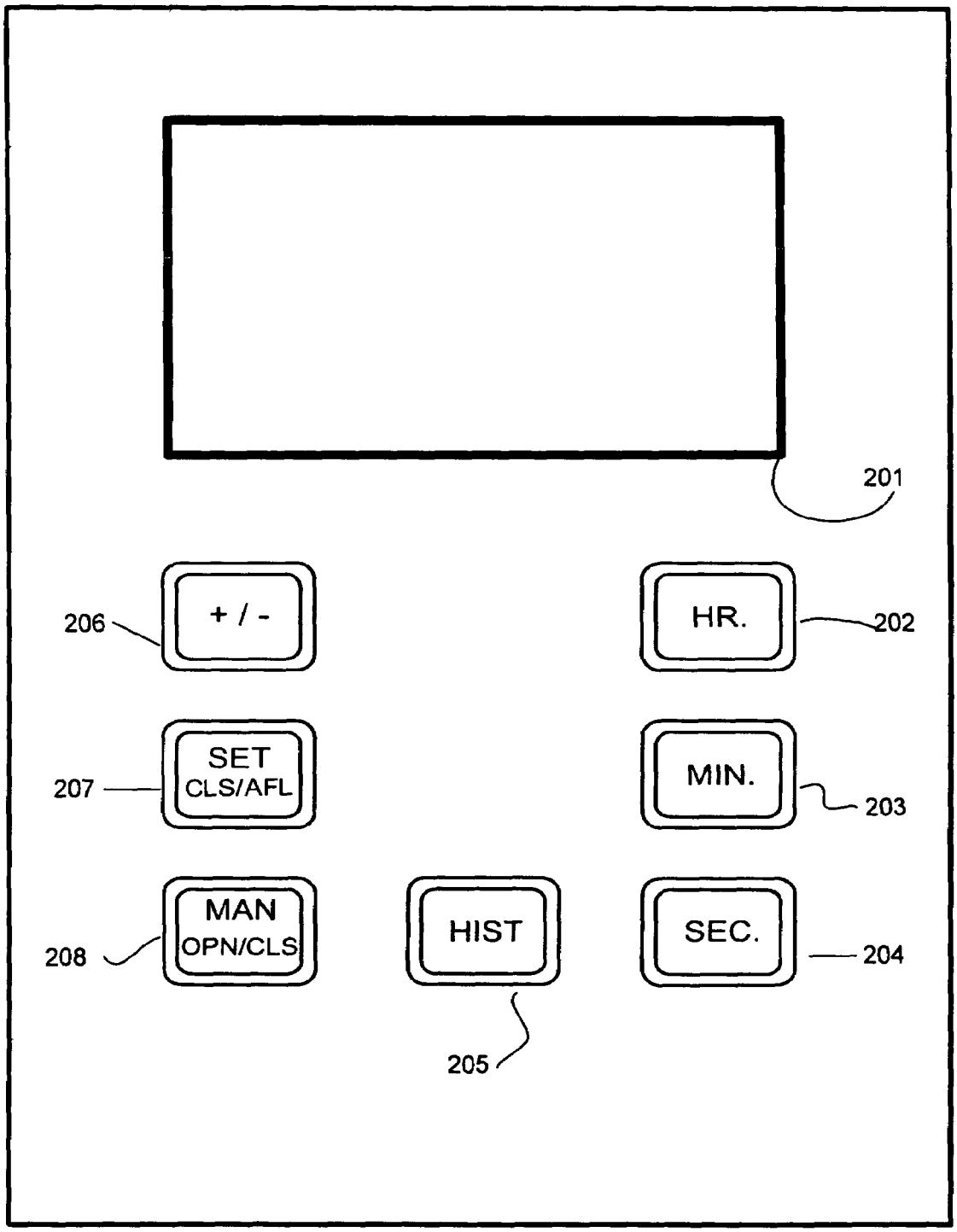
FIG. 2 shows a keypad of a Zadehan controller system in one embodiment of the invention used for operator entry and review of well data.

Controller system 200 includes a keypad and an alpha-numeric display 201 to allow for operator input. Keypads and displays suitable for use with this invention are well known in the art. FIG. 2 shows a typical keypad and display 201 located within controller system 200 described in FIG. 1 and herein below. The alpha-numeric display 201 shows operator entries, current cycle in use, in addition to well history items. Well history can be displayed by depressing or continuously depressing history key 205 for different well history items. History items may include, but are not limited to, total sales time, total close time, total open count, number of successful and failed plunger arrivals, plunger run times, and various recorded pressures. Depressing the history key 205 again after the last well history item is displayed will return to the current cycle display. Well depth, initial close time, and initial afterflow times are entered while the controller system 200 is in operator set mode. Operator set mode is entered by depressing the set key 207. While in operator set mode, close times and afterflow times are entered by depressing the hours key 202, minutes key 203, and seconds key 204. In one embodiment, well depth is entered by depressing the hours key 202 to add 10,000 feet increments, the minutes key 203 to add 100 feet increments, and the seconds key 204 to add 1 foot increments. Alternatively, the add/subtract key 206 will add or subtract time or feet when the hours key 202, minutes key 203, or seconds keys 204 are depressed. In one embodiment, the plunger lift control valve 10 can be manually opened and closed by an operator by depressing the manual key 208.

Figure 3:
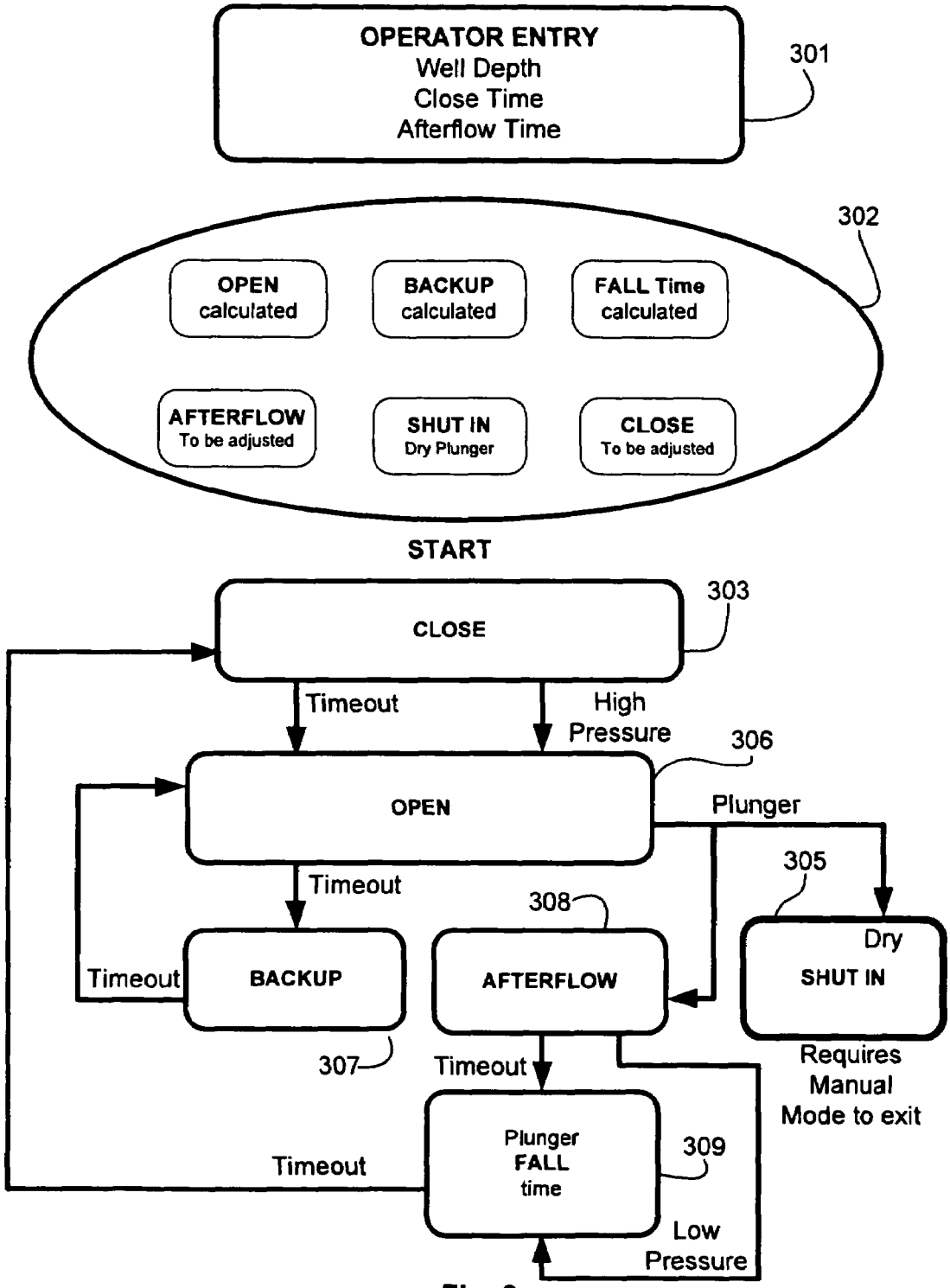
FIG. 3 illustrates an overview of the operator entry used with a Zadehan controller system of the present invention.

FIG. 3 illustrates firmware stored within the microprocessor of controller system 200 of the present invention. The completed operator entry items 301 are processed by the microprocessor to generate the calculated and adjusted values 302, which are stored in nonvolatile memory. The operator entry items 301 include well depth, initial close time, and initial afterflow time. Calculated and adjusted values 302 include the open time, backup time, and fall time. Determining the desired open time and fall time for a well are based on methods known in the art and can be modified by the experience and judgment of the well operator. Primarily, the open time and fall time depend on the well depth. The open time should be long enough to ensure the plunger 17 has enough time to rise to the surface and be detected by the plunger arrival sensor 2. The fall time should be long enough to ensure that the plunger 17 has enough time to return to the bottom of the production string 20 before the plunger lift control valve 10 is reopened. Methods for determining backup time are also known in the art. Backup time can vary according to the characteristics of each well and the judgment of the well operator, but the backup time will always be greater than the close time. In one embodiment, the backup time is approximately 1½ to 2½ times the close time.

The microprocessor also calculates the adjustments to the afterflow time and close time, and determines the parameters used to enter the shut in cycle 305 when a dry plunger is detected. A dry plunger means that the plunger 17 reached the top of the production string 20 without any accompanying fluids. This scenario is not within the normal operation of the well and may indicate that the plunger 17 is not reaching the bottom of the production string 20 during the fall cycle 309. This is a dangerous situation because a dry plunger can hit the upper bumper spring 4 at a much higher velocity than normal which can damage or rupture the top of the well. Typically, plunger 17 speed is not directly measured. Instead, an abnormally short plunger arrival time is assumed to indicate excessive plunger speed and a dry plunger. If the plunger arrival time is less than a time limit corresponding to the safest maximum plunger speed, the controller system will close plunger lift control valve 10 and enter the shut in cycle 305.

During a normal operating cycle, the microprocessor enters the close cycle 303. "Close" refers to the state of the plunger lift control valve 10 as controlled by the microprocessor. A timeout of the close cycle 303 or a high pressure signal from the annulus pressure sensor 1 will cause the microprocessor to enter the open cycle 306 and open the plunger lift control valve 10. When the plunger arrival sensor 2 detects a normal plunger arrival, the plunger lift control valve 10 remains open. The microprocessor then enters the afterflow cycle 308 and hydrocarbons can more freely flow from production string 20 into sales line 15. The microprocessor remains in the afterflow cycle 308 until a timeout of the cycle or a low pressure signal is received from annulus pressure sensor 1 or sales line pressure sensor 19. During the afterflow cycle 308, hydrocarbons are collected through the sales line 15.

If the afterflow cycle 308 ends as the result of a timeout, the microprocessor enters the plunger fall cycle 309. During the fall cycle 309, plunger lift control valve 10 is closed and plunger 17 is given sufficient time to return to lower bumper spring 18 at the bottom of the production string 20. At the end of the plunger fall cycle 309, the microprocessor enters the next normal close cycle 303. If the afterflow cycle 308 ends as a result of a low pressure signal, the microprocessor enters the fall cycle 309 and the motor valve 10 is closed. Close cycle 303 or afterflow cycle 308 may be adjusted by the microprocessor to account for the low pressure signal.

If the plunger arrival sensor 2 does not detect the arrival of the plunger 17 during the open cycle 306, the microprocessor will timeout and enter the backup cycle 307. The backup cycle 307 closes the motor valve 10 to allow a sufficient pressure to build within production string 20 and allow plunger 17 to arrive at the surface on the next open cycle 306. If a dry plunger is detected, the microprocessor will enter into the shut in cycle 305. This is an abnormal condition and requires an operator entry to leave the cycle and resume operation. It may be prudent at this time to check plunger 17 for damage before continuing operation. During the backup cycle 307, plunger fall time cycle 309, and shut in cycle 305, the microprocessor closes the motor valve 10.

In terms of environmental safety, detecting a dry plunger and entering the shut in cycle 305 is a very useful feature because it prevents damage to the well and prevents leaks to the environment. In a further embodiment, the controller system 200 also monitors the sales line pressure to determine if the sales line 15 has a leak or a break. If the sales line pressure sensor 19 detects a drop in pressure indicative of a leak or a break, the controller system 200 will enter the shut in cycle 305.

Figure 4:
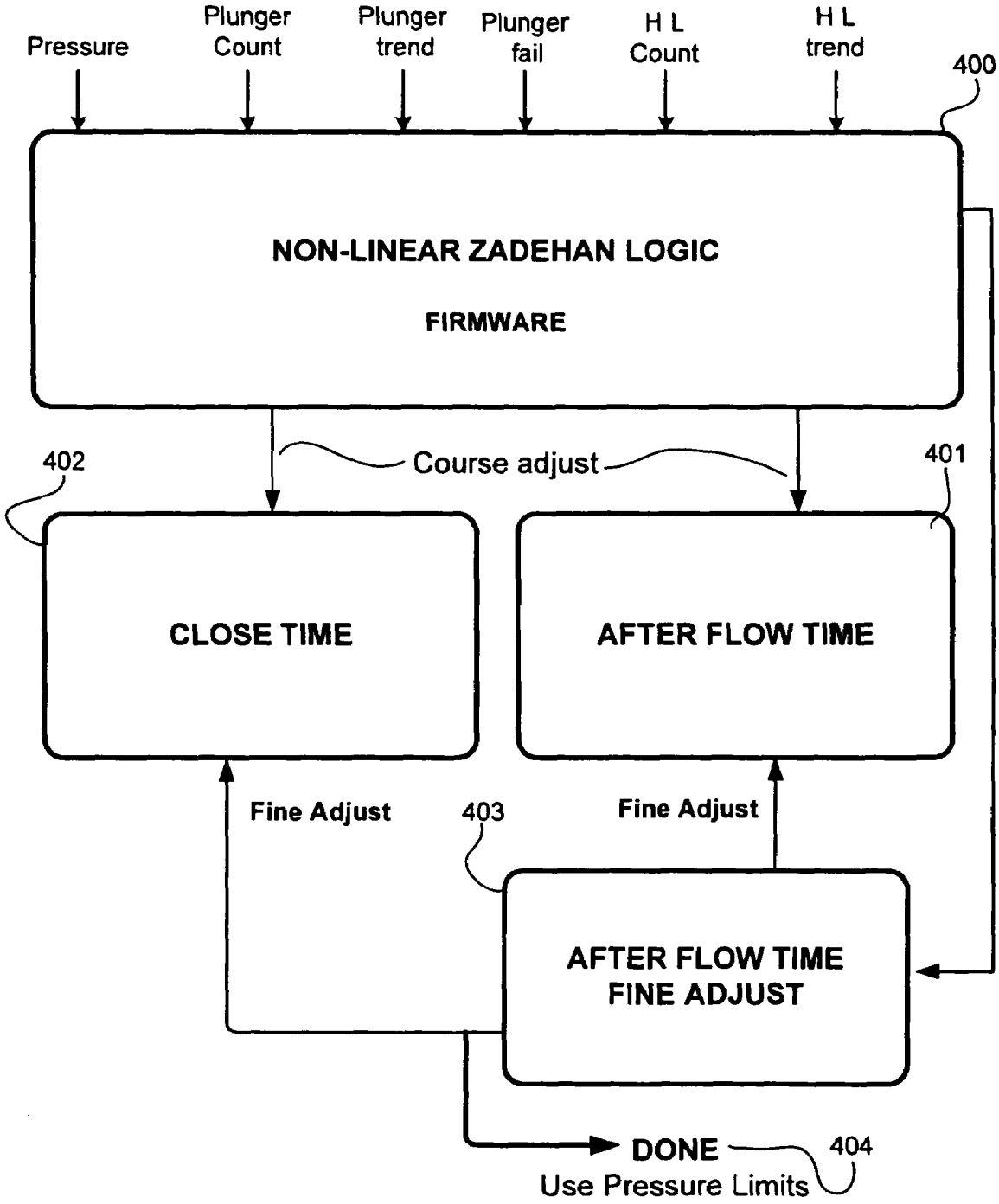
FIG. 4 illustrates an overview of the firmware modification control section used in a controller system of the present invention; and FIG. 5

FIG. 4 illustrates firmware stored on the microprocessor in one embodiment of the present invention. The firmware optimizes well production by adjusting the close time 402 and afterflow time 401. The microprocessor utilizes a non-linear Zadehan logic engine 400, previously referred to in the art as a "fuzzy logic" engine, to adjust the close time 402 and afterflow time 401. Because well operation is non-linear, the optimization process is also non-linear. The current operating cycle has the highest priority in altering well operation while previous cycles have a lower priority. The Zadehan logic engine 400 reduces the close time 401 until it reaches the optimal time period. Conversely, afterflow time 401 is extended to increase hydrocarbon production until it also reaches its optimal time period. If a specific afterflow time 401, close time 402 or well condition corresponds to a failed plunger arrival, the microprocessor will adjust the close time 402 or afterflow time 401 to avoid repeating the same conditions.

It should be noted that the controller system of the present invention does not adjust the close time or afterflow time based on whether well characteristics such as the plunger arrival time or plunger speed fall within a predetermined range. Instead, the present invention compares well characteristics exhibited during the current operating cycle to previous cycles and adjusts the close time and afterflow time based on the trends exhibited by the well during its operation. Trend information is typical of how humans evaluate a series of recorded numbers or graphical information.

Controller system 200 uses a number of recorded variables to adjust the close time 402 and afterflow time 401. In one embodiment of the invention, the Zadehan logic engine 400 adjusts the close time and afterflow time based on pressure, plunger count, plunger trend, plunger fail, high to low transition count, high to low transition trend, and combinations thereof.

Plunger trend is the determination of whether the plunger arrival time in the current cycle is faster, slower or the same compared to the plunger arrival time in the previous cycle. The microprocessor in controller system 200 records plunger trend as an integer which is incremented or decremented according to whether the current plunger time is greater or lesser than the previous plunger time. A plunger trend over several cycles showing a steady, consistent plunger arrival time is an indication of stability in the close time and afterflow time adjustments.

Plunger count is the total number of plunger arrivals. Plunger fail is when the controller system 200 fails to detect the successful arrival of the plunger 17 at the lubricator 5 during the open cycle.

During normal operation, the pressure within a well casing 22 will drop when the well switches to from a close cycle to an open cycle. The time it takes for the pressure in well casing 22 to complete the transition from the higher pressure of the close cycle to the lower pressure of the open cycle is known as the high to low transition time, or HL count. HL count will vary from well to well, and will most likely vary within the same well from one close-open cycle to the next. Generally, a lower HL count is preferable to a high HL count. More important is the trend of whether the HL count is increasing, decreasing or the same from one run to the next. The controller system 200 records the high to low transition trend (HL trend) as an integer, which is incremented or decremented according to whether the HL count has increased or decreased from the last cycle. An HL trend indicating that the HL count is decreasing can be an indication that the adjustments to the well cycles are having a desired effect. An HL trend indicating that the HL count is remaining stable is an indication of well optimization.

Pressure information is recorded at various operating cycle boundaries and is used for cycle limits. Minimum and maximum values with various time limits are selected to insure well stability and optimization.

In one embodiment, as shown in FIG. 4, the Zadehan logic engine 400 reduces the close time 402 in a series of operating cycles until a failed plunger arrival is detected. The close time 402 is then increased sufficiently so that plunger 17 successfully arrives at the top of the production string 20. The Zadehan logic engine 400 then adjusts the afterflow time 401 in the subsequent operating cycles until the well operation is stable. Typically, the afterflow time 401 is increased to allow for the greatest amount of gas production that still results in stable well operation.

After afterflow time 401 is adjusted, the well is allowed to operate without additional adjustments in order to allow the well to stabilize. After a consecutive number of successful operating cycles during which no additional adjustments are made, the Zadehan logic engine 400 will fine adjust 403 the afterflow time 401 and, if necessary, the close time 402 and then stop adjusting (represented by the done step 404). Once the fine adjust 403 step has been completed, the well will operate according to the adjusted afterflow time 401 and adjusted close time 402 to provide improved hydrocarbon production from that well. Additionally, well casing 22 and production string 20 pressure limits may be used to open and close the plunger lift control valve 10 during this time if necessary. The optimization process can be restarted with a new operator entry at controller system 200. All of the related variables are saved in the nonvolatile memory of the microprocessor, allowing restarting at the same adjustment setting.

The pressure difference between production string 20 and well casing 22 during the operating cycle can be used as further indicator of well optimization. The production string 20 pressure and well casing 22 pressure will be very close to the same and will rise and lower uniformly on each cycle if efficient well operation is being achieved. The pressures will never match exactly because the production string 20 will never be completely free of fluids. Generally in an efficient plunger lift well, the production string pressure will be approximately 80-85% of the well casing pressure. In a further embodiment, the controller system 200 records the pressure difference between the well casing 22 and the production string 20. The Zadehan logic engine 400 will adjust or stabilize the afterflow time 401 and close time 402 based on how closely the production string pressure resembles the well casing pressure.

Figure 5:
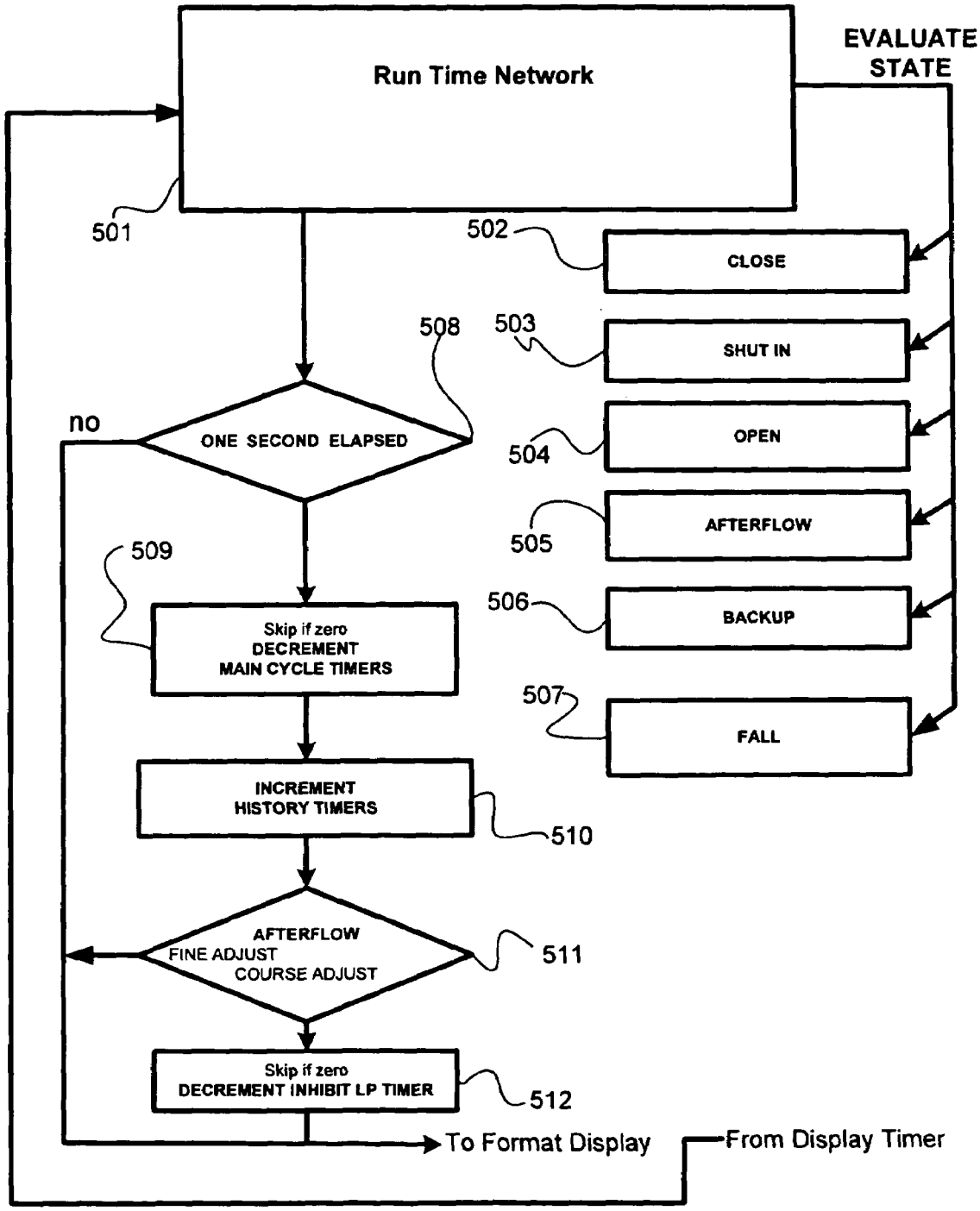
FIG. 5A illustrates an overview of the firmware run time network used in a controller system of the present invention.
Figure 5A:
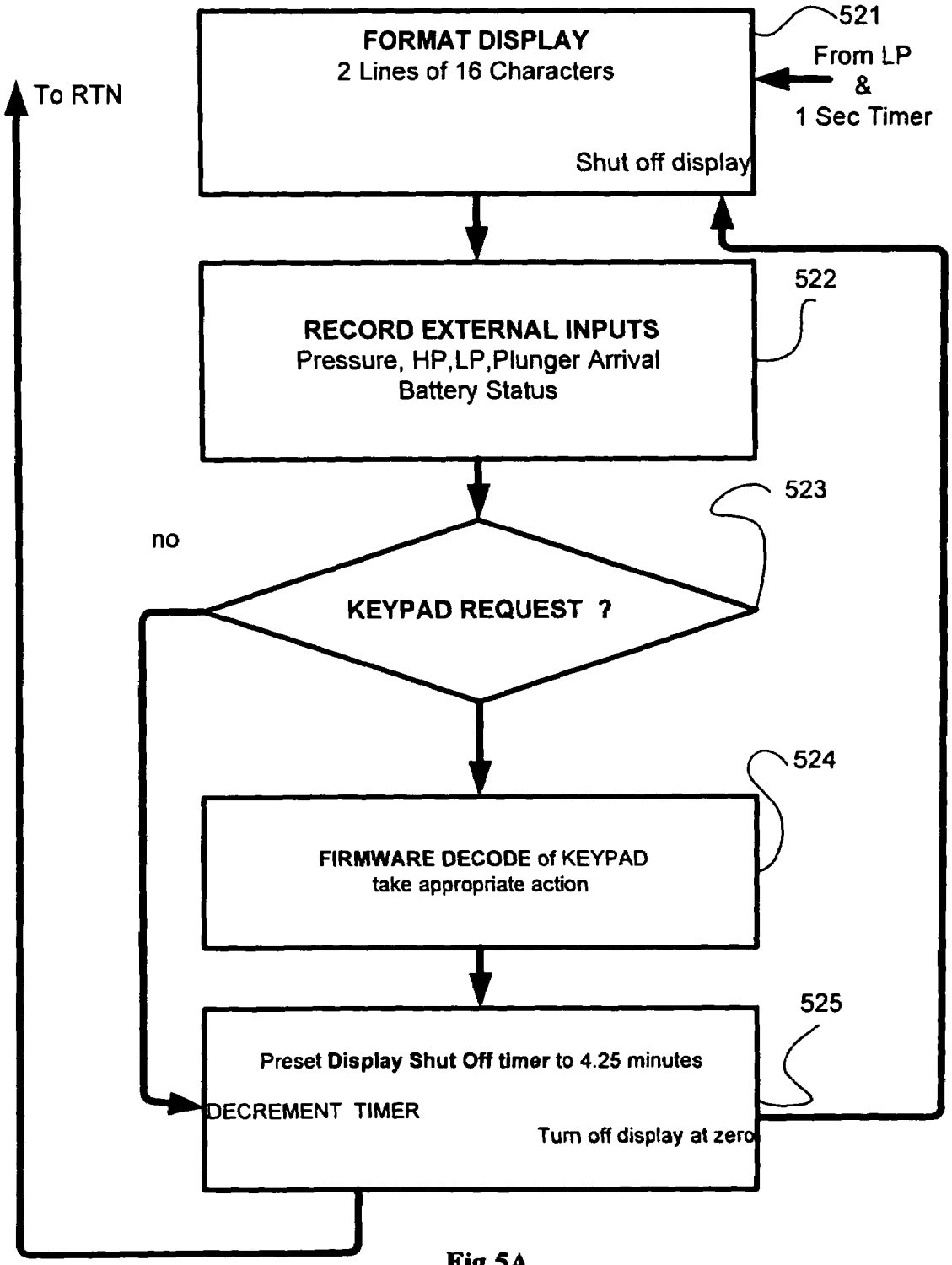

FIG. 5 and FIG. 5A illustrates a Run Time Network (RTN) used in a controller system 200 of the present invention. The RTN shell 501 evaluates the current cycle state, selecting a new state if required. The cycle state may be the close state 502, shut in state 503, open state 504, afterflow state 505, backup state 506, or fall state 507. Each second 508 the current main timer 509 and well history timers 510 are adjusted and updated in the microprocessor memory. If the current cycle is the afterflow cycle 511, that cycle is also adjusted. A low pressure input inhibited 512 during the initial change to the afterflow cycles is also adjusted and updated. The display 521 is alphanumeric and displays operator entry, current cycle information, and well history. External inputs are recorded and used by the RTN shell 501 to select the current cycle. When the keypad is active 523 the firmware decodes 524 the keypad input and the proper response is initiated. The display 521 will shut off to conserve power after a predetermined time, say about 4.25 minutes as shown in FIG. 5A, has elapsed after the last key pad activity 525. Any subsequent keypad activity will cause the display 521 to be turned back on.

Now, with the system of the present invention in mind, in one embodiment of the present invention, an operator initially, for example, enters predetermined values for well depth, initial close time and initial afterflow time into the controller system 200 microprocessor memory through a keypad, such as described with respect to FIG. 2, above. The microprocessor of the controller system 200 will calculate the open time, fall time and backup time. The controller system 200 will enter a close cycle 303 for a period of time equal to the initial close time. During the close cycle 303, the plunger lift control valve 10 is closed and the plunger 17 remains at the bottom of the production string 20. The pressure within the well casing 22 will increase during the close cycle 303. Upon timeout of the close cycle 303 or a high pressure signal from the annulus pressure sensor 1, the controller system 200 will terminate the close cycle 303, enter the open cycle 306, and open the plunger lift control valve 10. Once the plunger lift control valve 10 is opened, the built up pressure will lift plunger 17 and the fluids that have accumulated above plunger 17 to the surface and into the sales line 15. Plunger arrival sensor 2 connected to controller system 200 will detect when plunger 17 arrives at the surface. Upon timeout of the open cycle 306, the controller system 200 enters the afterflow cycle 308, during which the motor valve 10 remains open and hydrocarbons can more freely flow through production string 20 into sales line 15. Controller system 200 remains in the afterflow cycle 308 until a timeout of the cycle or a low pressure signal is received from the annulus pressure sensor 1 or sales line pressure sensor 19. After the afterflow cycle 308 is terminated, controller system 200 closes the plunger lift control valve 10 and enters the close cycle 303 for the next operating cycle. When plunger lift control valve 10 is closed, plunger 17 will return to the bottom of the production string 20 and remain there until the next open cycle 306.

During successive operating cycles, the controller system 200 will gradually decrease the close time 402 until a failed plunger arrival is detected. The controller system 200 will then enter a backup cycle 307 and increase the close time 402 so that sufficient pressure is built up in production string 20 to cause a successful plunger arrival. Controller system 200, utilizing Zadehan logic, adjusts the afterflow time 401 in subsequent operating cycles with variables such as pressure, plunger count, plunger fall, plunger trend, high to low transition count, and high to low transition trend. Plunger trend, high to low transition count, and high to low transition trend have not been used in previous control systems to optimize well operation. After the afterflow time 401 has been adjusted, the well is allowed to operate without additional adjustments in order to allow the well to stabilize. After a consecutive number of successful operating cycles during which no additional adjustments are made, the controller system 200 will fine adjust 403 the afterflow time 401, and the close time 402 if necessary to provide improved hydrocarbon production. It should be noted that previous control systems also do not allow the well to stabilize between adjustment periods, and it has been determined that lack of adjustment can prevent optimal well operation. After the controller system 200 fine adjusts the afterflow time 401 and close time 402, the well is allowed to operate without additional adjustments.

All references cited herein are hereby incorporated by reference in their entirety to the extent that there is no inconsistency with the disclosure of this specification. All headings used herein are for convenience only. All patents and publications mentioned in the specification are indicative of the levels of skill of those skilled in the art to which the invention pertains, and are herein incorporated by reference to the same extent as if each individual publication, patent or patent application was specifically and individually indicated to be incorporated by reference. References cited herein are incorporated by reference herein in their entirety to indicate the state of the art as of their publication or filing date and it is intended that this information can be employed herein, if needed, to exclude specific embodiments that are in the prior art.

Having now fully described the present invention in some detail by way of illustration and examples for purposes of clarity of understanding, it will be obvious to one of ordinary skill in the art that the same can be performed by modifying or changing the invention within a wide and equivalent range of conditions, formulations and other parameters without affecting the scope of the invention or any specific embodiment thereof, and that such modifications or changes are intended to be encompassed within the scope of the appended claims.

We claim:

1. A method for optimizing the operation of a plunger lift well comprising a well casing, production string within the well casing, a take-off line in fluid communication with the production string, a plunger within the production string, a plunger lift control valve connected between the production and the take-off line, and a controller system having a memory and a non-linear Zadehan logic engine, wherein the controller system serves to open and close the plunger lift control valve according to values calculated or stored within the controller system, said method comprising the steps of:

a) entering a predetermined value for well depth, close time, and afterflow time into the controller system memory, wherein the controller system automatically calculates the open time based on the entered predetermined values;

b) conducting one or more operating cycles wherein the controller system opens and closes the plunger lift control valve to allow fluids or hydrocarbons to flow into the take-off line, said one or more operating cycles comprising:

entering a closed cycle and closing the plunger lift control valve for a period of time equal to the initial close time;

entering an open cycle and opening the plunger lift control valve for a period of time equal to the calculated open time and allowing fluids to be artificially lifted by the plunger within the production string and allowing such fluids and hydrocarbons to flow into the take-off line; and entering an afterflow cycle for a period of time equal to the initial afterflow time and allowing hydrocarbons to flow into the take-off line during the afterflow cycle;

c) adjusting the close time or the afterflow time, wherein the non-linear Zadehan logic engine evaluates well measurements from one or more previously completed operating cycles stored in the controller system memory and adjusts the close time and afterflow time according to said evaluations;

d) conducting one or more adjusted operation cycles, each adjusted operation cycle comprising:

entering a closed cycle for a period of time equal to the adjusted close time and closing the plunger lift control valve;

entering an open cycle for a period of time equal to the calculated open time and opening the plunger lift control valve; and entering an afterflow cycle for a period of time equal to the adjusted afterflow time and collecting gas from the sales lines during the afterflow cycle.

2. The method of claim 1 wherein the closing time is decreased and the afterflow time is increased after one or more operating cycles.

3. The method of claim 1 wherein said controller system calculates fall time based on entered predetermined values.

4. The method of claim 3 further comprising closing the motor valve after the completion of the afterflow cycle and entering a fall cycle for a period of time equal to the calculated fall time.

5. The method of claim 1 further comprising detecting for the presence of a plunger at the top of the production string during said open cycle.

6. The method of claim 1 wherein said controller system calculates the backup time based on the entered predetermined values for well depth, initial close time, and afterflow time.

7. The method of claim 6 further comprising detecting whether the plunger fails to arrive at the top of the production string during an open cycle, and if so, entering a backup cycle and closing the plunger lift control valve for a period of time equal to the calculated backup time, and entering an open cycle and opening the plunger lift control valve for a period of time equal to the calculated open time.

8. The method of claim 7 further comprising increasing the close time if the plunger fails to arrive at the top of the production string during an open cycle.

9. The method of claim 1 further comprising detecting the arrival of a dry plunger at the top of the production string and stopping well operation.

10. The method of claim 1 further comprising detecting the arrival of a plunger at the top of said production string during the open cycle of two or more operating cycles, recording the plunger arrival times in the controller system memory, comparing the plunger arrival times of said two or more operating cycles, and adjusting the close time based on the plunger trend.

11. The method of claim 10 further comprising adjusting the afterflow time based on the plunger trend.

12. The method of claim 1 further comprising measuring the pressure within the production string and recording said pressure in the controller system memory.

13. The method of claim 12 further comprising measuring pressure within the well casing and recording the maximum and minimum well casing pressures during one or more operation cycles or one or more adjusted operation cycles into the controller system memory.

14. The method of claim 13 further comprising detecting the pressure within the sales line and recording the maximum and minimum pressures in the sales line during one or more operation cycles or one or more adjusted operation cycles in the controller system memory.

15. The method of claim 14 further comprising terminating a close cycle when the well casing pressure exceeds the pressure in the sales line by a predetermined amount, entering an open cycle, and opening the plunger lift control valve.

16. The method of claim 14 further comprising terminating an afterflow cycle when the current pressure in the take-off line is less than the minimum recorded well casing pressure by a predetermined amount.

17. The method of claim 13 further comprising terminating an afterflow cycle when it is determined that the then current well casing pressure is less than the minimum recorded well casing pressure by a predetermined amount.

18. The method of claim 1 comprising measuring the pressure within the production string and well casing and recording said pressure in the controller system memory.

19. The method of claim 18 comprising adjusting the close time or afterflow time based on the pressure difference between the production string and well casing.

20. The method of claim 1 comprising measuring and recording the pressure within the well casing during the closed cycle and the open cycle and recording the high to low transition time into the controller system memory.

21. The method of claim 20 comprising comparing the high to low transition times of two or more operating cycles and adjusting the close time or afterflow time based on the high to low transition trend.

22. The method of claim 1 further comprising decreasing the closing time for one or more operating cycles until the plunger fails to arrive at the top of the production string during an open cycle; increasing the close time so that the plunger arrives at the top of the production string during subsequent open cycles; and fixing the close time so that no further adjustments are made to the close time.

23. The method of claim 22 further comprising adjusting the afterflow time after the close time has been adjusted.

24. An artificial lift well apparatus comprising a well casing, a production string within the well casing, a plunger disposed within the production string, a sales line in fluid communication with the production string, a plunger lift control valve connected between the production string and the sales line, and a controller system comprising a non-linear Zadehan logic engine, wherein said controller system includes means to:

a) open and close the motor valve according to values calculated or stored within the controller system;

b) conduct one or more operating cycles wherein the controller system opens and closes the plunger lift control valve to allow fluids or gasses to flow into sales line, said one or more operating cycles comprising:

entering a closed cycle and closing the motor valve for a period of time equal to the initial close time;

entering an open cycle and opening the plunger lift control valve for a period of time equal to the calculated open time and allowing fluids to be artificially lifted allowing said fluids to flow into the sales line; and entering an afterflow cycle for a period of time equal to the initial afterflow time and allowing gases to flow into the take-off lines during the afterflow cycle;

c) adjust the close time or the afterflow time wherein the non-linear Zadehan logic engine evaluates well measurements from one or more previously completed operating cycles stored in the controller system memory and adjusts the close time and afterflow time according to said evaluations;

d) conduct one or more adjusted operation cycles, each adjusted operation cycle comprising:

entering a closed cycle for a period of time equal to the adjusted close time and closing the plunger lift control valve;

entering an open cycle for a period of time equal to the calculated open time and opening the plunger lift control valve; and entering an afterflow cycle for a period of time equal to the adjusted afterflow time and collecting gas from the take-off lines during the afterflow cycle.

* * * * *